US005785251A

United States Patent [19]

Wood et al.

[11] Patent Number: 5,785,251

[45] Date of Patent: Jul. 28, 1998

[54] AIR ASSIST FUEL INJECTOR

[75] Inventors: Ross W. Wood, Yorktown; Debora Nally, Williamsburg; Lisa Egizi, Newport News, all of Va.

[73] Assignee: Siemens Automotive Corporation, Auburn Hills, Mich.

[21] Appl. No.: 530,034

[22] Filed: Jun. 28, 1995

Related U.S. Application Data

[63] Continuation-in-part of Ser. No. 495,387, Jun. 27, 1995, abandoned.

[51] Int. Cl.[6] ..... F02M 51/00

[52] U.S. Cl. ..... 239/417.3; 239/585.4

[58] Field of Search ..... 239/600, 585.1–585.5, 239/533.3–533.12, 417.3, 416.5, 408

[56] References Cited

U.S. PATENT DOCUMENTS

| | | | |
|---|---|---|---|
| 4,645,127 | 2/1987 | Emory et al. | 239/600 |
| 4,863,105 | 9/1989 | Bennet | 239/600 |
| 4,957,241 | 9/1990 | Roger | 239/600 |
| 5,402,937 | 4/1995 | Buchholz et al. | 239/585.5 |
| 5,437,413 | 8/1995 | Shen et al. | 239/585.4 |
| 5,449,120 | 9/1995 | Tani et al. | 239/585.5 |

FOREIGN PATENT DOCUMENTS

| | | | |
|---|---|---|---|
| 6065 | 1/1985 | Japan | 239/585.4 |

*Primary Examiner*—Kevin Weldon

*Attorney, Agent, or Firm*—Russel C. Wells

[57] ABSTRACT

An air assist fuel injector wherein a shroud member is snapped on the outside of the valve body to provide a path for assist air to atomize the fuel exiting the injector. Located on the bottom surface of the shroud is a belleville washer to preload air deflection disks against the bottom of the valve body. Snap-on connectors cooperate with the valve body to locate and retain the shroud to the valve body.

4 Claims, 3 Drawing Sheets

AIR ASSIST FUEL INJECTOR

This is a continuation-in-part of application Ser. No. 08/495,387 filed on Jun. 27, 1995 now abandoned.

FIELD OF THE INVENTION

This invention relates to fuel injectors in general and more particularly to shrouds for converting a fuel injector into an air assist fuel injector.

BACKGROUND OF INVENTION

U.S. Pat. No. 5,174,505, entitled "Air Assist Atomizer for Fuel Injector" was issued on Dec. 29, 1992 to J. J. Shen and assigned to a common assignee. In that patent, there is disclosed and claimed a shroud member with an air flow disk. The shroud is secured to a fuel injector and cooperates therewith to provide an air assist injector. In that patent, the shroud is typically molded from a plastic material and is bonded to the injector.

The complete air assist injector is then loaded into an engine manifold and sealed by means of O-rings about the circumference of the shroud and the valve body of the injector. An air supply is connected to the air inlet of the shroud and the fuel ejected from the injector into the manifold is broken up into a fine mist by the air.

SUMMARY OF THE INVENTION

In the above identified U.S. patent, the air flow disk is installed by means of mechanically "sandwiching" the disk between two flat surfaces, namely the "back-up washer" and the "shroud" surfaces. The shroud assembly is then axially preloaded to a given force and the crimped in place by mechanically deforming the shroud material. The shroud is purposely made to allow a "cantilever" effect to constantly stress the shroud material, be it metal or plastic, in order to guarantee the tight assembly. However, this stress could relax after time and cause the air flow disk to separate from its mating surfaces, especially with the use of plastic which creeps under force/temperature loading. When the material creeps, the air flow would not be controlled to a degree required for proper operation of the air-assist injector.

In order to overcome these problems of creep, the improvement herein, of mechanically attaching the shroud to the injector by means of a cantilevered snap on connector allows the air flow to remain controlled even if the shroud or disk shifts or relaxes in an axially direction after time.

In order to accomplish the above identified objective, there is described and claimed an air-assisted fuel injector having an outlet end for injecting fuel into an induction air system of an internal combustion engine. An air assist means, a shroud, is fitted onto the valve body of the injector for directing assist air to flow axially along the outside of the valve body and then radially inwardly toward the ejected fuel that has just left the outlet end of the injector to assist in atomizing the same. An end wall of the shroud extends radially inwardly from the side wall to form an aperture means through which the ejected fuel that has just left the outlet end of the injector passes. An insert member means comprising one or more air directing disks is sandwiched axially between both the end wall of the shroud and the outlet end of the injector. The shroud member is axially loaded onto the valve body to maintain the insert member in an air tight relationship between the end wall and the outlet end of the injector. The improvement is the positioning of a belleville washer between the end wall of the shroud and the insert member to provide an axially directed preload force to maintain the insert member against the outlet end of the injector.

These and other advantages will be apparent from the following drawings and detailed description of a preferred embodiment.

DETAILED DESCRIPTION OF THE PREFERRED EMBODIMENT

Figure 1:
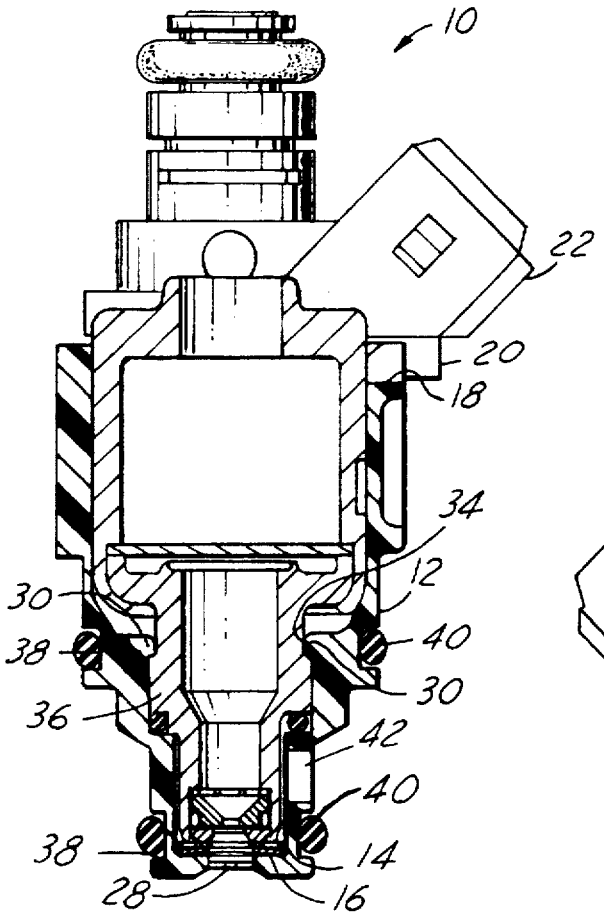
FIG. 1 is a longitudinal view partially in cross section with some parts removed of a fuel injector illustrating the air assist shroud member according to the present invention.

Referring to FIG. 1 there is illustrated a top feed electromagnetically operated fuel injector 10 having at least one orifice 28 in the outlet end with the air assist shroud 12 according to the present invention. The operation of a fuel injector is well known and will not be described here. Of particular importance is the shroud member 12, an air distribution disk 14 and a belleville washer 16.

Figure 5:
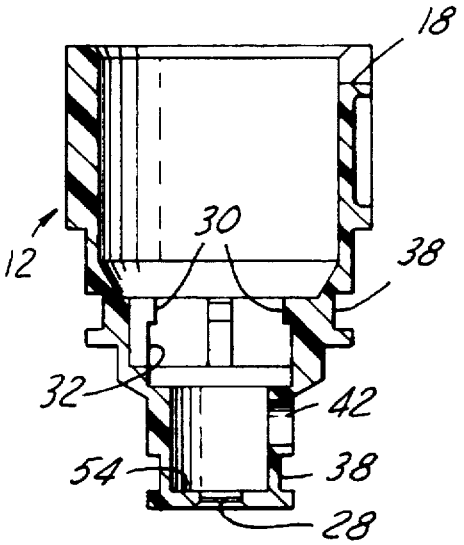
FIG. 5 is a longitudinal cross-sectional view of the shroud taken along line 5—5 of FIG. 4 illustrating the snap on connector and other features of shroud.
Figure 6:
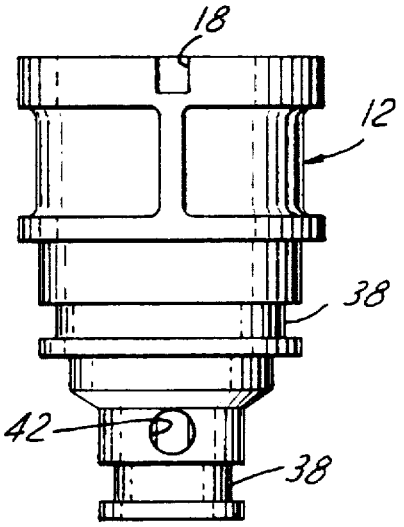
FIG. 6 is a side view of the shroud illustrating the keyway for locating the shroud on the injector connector.

Referring to FIG. 5, which is a section view of the shroud 12, there is shown the several features which maybe contained in a shroud. The first feature is a location means comprising a keyway 18 which is sized to fit or enclose a key means 20 extending from the overmolded connector body 22 in a direction toward the outlet end of the injector or on the bottom of the connector overmold 22. The connector body 22 has terminals for receiving an electrical signal to operate the injector. In the alternative, as illustrated in the shroud 24 shown in FIG. 3 on an extended tip fuel injector 25, the location means on the shroud 24 may have a key 26 axially extending from the other end of the shroud, the end opposite the outlet end of the injector. A keyway means is molded in the connector overmold 22 which axially extends from the surface of the connector body in an axial direction away from the outlet end of the injector. In either case, the function of the key 20, 26 and keyway 18 is to position and accurately locate the output orifices 28 of the shroud 12 in accordance with the output of the metering orifices of the injector 10 and to prevent rotation of the shroud relative to the output orifices.

When the injector is a split stream injector, wherein the at least one orifice is two or more spaced apart orifices, the location means functions to locate the shroud in such a manner so as to cause the air assist flowing from the shroud to be in the proper direction for mixing with the fuel from the orifices.

Figure 3:
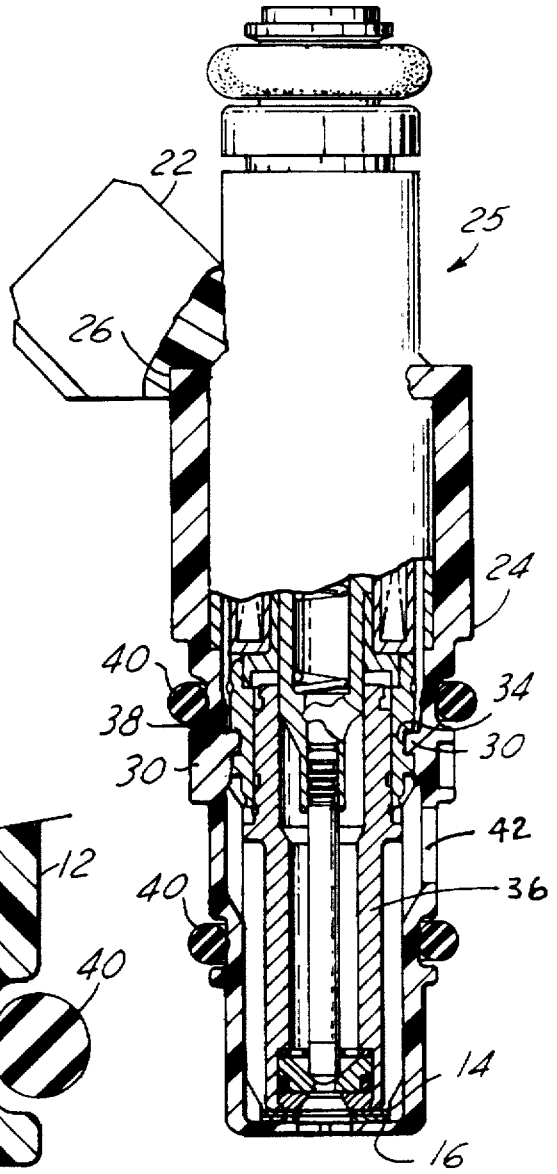
FIG. 3 is another view partially in cross section of an extended tip injector illustrating the air assist shroud member according to the present invention.
Figure 8:
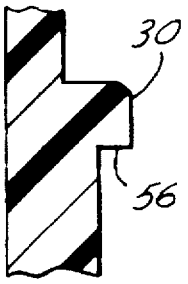
FIG. 8 is section view of the snap-on connector.

Next there is illustrated the snap on connectors 30. One such snap-on connector 30 is shown in an enlarged sectional view in FIG. 8. Typically there are two equally and angularly spaced around one of the inside surfaces 32 of the shroud 12. Each snap on connector 30 is typically L-shaped and operates to snap into a circumferentially formed grove 34 formed on the outer diameter of the valve body 36 of the injector 10 or 25. The purpose of the snap-on-connectors 30 is to secure the shroud 12 or 24 to the injector as illustrated in FIGS. 1 and 3.

There are at least two circumferential channels 38 around the outside of the shroud 12 and 24 for the location and containment of O-rings 40. The O-rings 40 are used to seal the shroud in a manifold or similar part of the engine, not shown. Located on one side of the shroud 12 or 24 is an air intake port 42 for mating with an air supply means, not shown, located in the engine. Such an air supply may be by individual conduits or may be a single conduit. On the inside surface of the shroud 32, the shroud cooperates with the valve body 36 to form an axially extending passageway means via which the assist air passes axially along the outside of the valve body from the air intake 42 to the outlet end of the injector 46.

Figure 7:
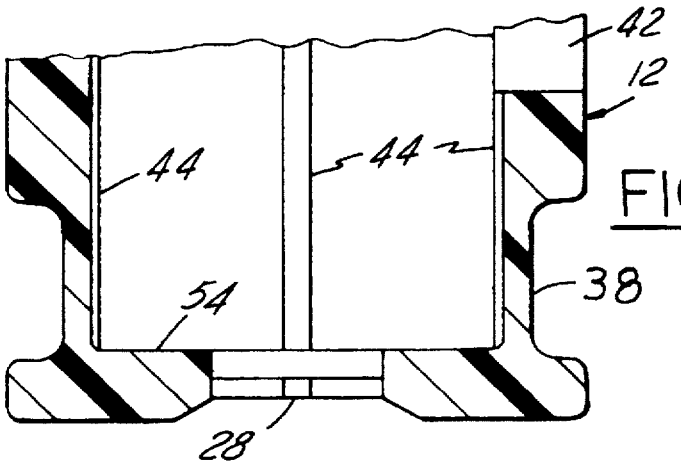
FIG. 7 is an enlarged view of the outlet end of the shroud illustrating the locating means for the air flow disks.

Referring to FIG. 7, there is illustrated the bottom of the shroud 12 or 24 to illustrate the method of maintaining the air disks 14 in the proper orientation in the bottom of the shroud. There are at least two equally and angular spaced locating means 44 such as a U-shaped channel, an axially extending key, or similar means. The perimeter of the air disks 14 is formed complimentary to the locating means 44. The location of the locating means 44, the outlet orifice or orifices of the shroud 28 and the key 18 or keyway mating with the connector overmold 22, is critical to the direction of the air fuel mixture exiting the shroud and impacting on the intake valve of the engine. The shroud 12 cooperates with the injector 10 to aim the air-fuel mixture as required.

Figure 2:
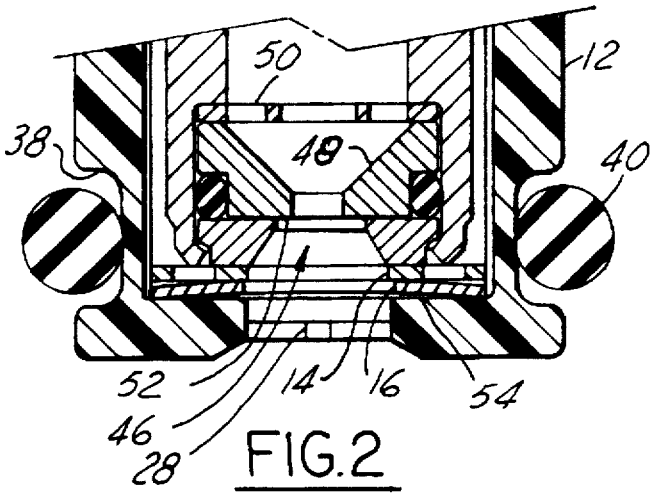
FIG. 2 is a cross sectional enlarged view of the outlet end of the injector end including the shroud of the injector of FIG. 1.
Figure 4:
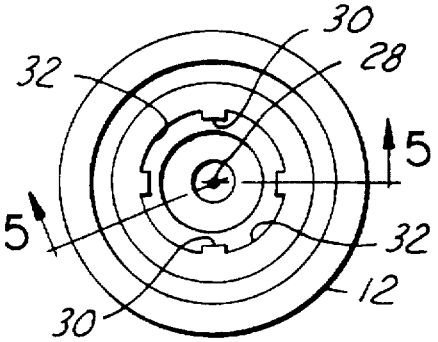
FIG. 4 is a plan view of the shroud.

Now referring back to FIG. 2, there is illustrated the outlet end 46 of the injector 10 including the valve seat 48, lower valve needle guide 50, orifice member 52, air disk 14 and the belleville washer 16. The orifice member 52 functions to meter the fuel from the injector and is a thin flat disk that shows up as a line in the drawing. Such an orifice member disk may be that illustrated in U.S. Pat. Nos. 4,923,169; 4,934,653; and 4,958,430 all assigned to a common assignee.

The shroud 12 is molded from a plastic material and is slid onto the valve body 36 of the injector. In prior air-assist shrouds, the shroud is secured to the injector by means of some adhesive or is crimped into place. In the preferred embodiment, the snap on connectors 30 are spaced apart as the shroud is slid along the valve body 36 until the end of the connector snaps into the circumferential grove 34 in the valve body 36.

Prior to locating the shroud 12 on the valve body 36, a belleville washer 16 is located on the bottom surface 54 of the inside of the shroud 12. Next one or more air disks 14 are located on the top the belleville washer 16 by means of the locating means 44. Next the shroud 12 is positioned on the end of the valve body 36 and is located there by means of the key 18 or keyway and the connector overmold 22. As the shroud 12 is axially moved relative to the valve body 36 and the overmold of the upper part of the injector, the snap-on connectors 30 are cantilevered into the circumferential groove 34.

Figure 9:
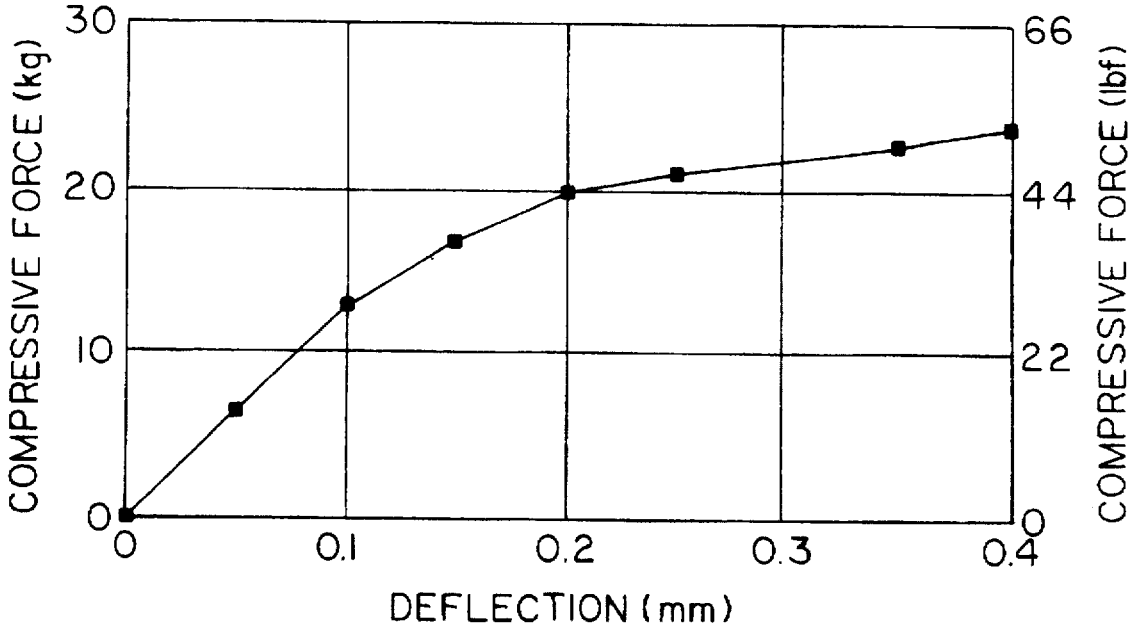
FIG. 9 is graph of force vs. deflection for the belleville washer.

The inside dimension from the flat part 56 of the snap-on connector 30 to the bottom surface 54 of the inside of the shroud 12 is so dimensioned that the stack-up tolerances of the injector components are compensated by the allowable axial travel of the belleville washer 16. The belleville washer 16 has a thickness (t) of 0.3 mm and free height (H) of approximately 8 mm. The stack-up tolerances may be on the order of 1500 microns. Hence the nominal preloaded height of the washer is about 250 microns. Thus as the stack up tolerances vary, the washer preload height varies from 100 to 400 microns which, depending upon the washer selected will preload the air disks 14 against the bottom of the injector with a compressive force between 10 Kg (22 lbf) and 24 Kg (54 lbf). As the plastic thermally creeps, the belleville washer 16 will operate to maintain sufficient force to keep the air disks 14 tight to themselves and to the bottom of the injector. FIG. 9 is a graph of the force on the abscissa axis vs. deflection on the ordinate axis of the selected belleville washer having an H/t=1.5.

Referring to FIG. 3, there is illustrated the shroud 24 of the preferred embodiment on an extended tip injector 25. In this example, the tip of the injector is extended out into the air stream flowing in the manifold into the engine cylinder.

There has thus been shown and described a molded shroud to convert a standard injector into an air-assist injector.

What is claimed is:

1. An air-assisted fuel injector having a valve body with an outlet end for injecting fuel into an induction air system of an internal combustion engine having an air assist means fitted onto the valve body for directing assist air to flow axially along the outside of the valve body and then radially inwardly toward the ejected fuel that has just left the outlet end of the injector to assist in atomizing the same, said air assist means being axially loaded onto the valve body;

said air assist means having an end wall extending radially inwardly from the side wall to form an aperture means through which the ejected fuel that has just left the outlet end of the injector passes;

an insert member means including one or more air directing disks sandwiched axially between both the end wall of the air assist means and the outlet end of the injector;

wherein the improvement comprises a belleville washer interposed in the space between the end wall of the air assist means and the insert member means to provide an axially directed preload force to maintain the insert member means against the outlet end of the injector and to maintain an air tight relationship between said end wall and the insert member means.

2. An air-assisted fuel injector according to claim 1 wherein said preload force from said belleville washer provides an minimum force of 125 Newtons.

3. An air-assisted fuel injector according to claim 1 wherein said belleville washer has a height to thickness ratio greater than 1.0.

4. An air-assisted fuel injector according to claim 3 wherein said belleville washer has a height to thickness ratio between 1.25 and 1.5.

* * * * *

UNITED STATES PATENT AND TRADEMARK OFFICE

CERTIFICATE OF CORRECTION

PATENT NO. : 5,785,251

DATED : July 28, 1998

INVENTOR(S) : Wood et al

It is certified that error appears in the above-indentified patent and that said Letters Patent is hereby corrected as shown below:

On the title page, under filing date, change June 28, 1995 to:

-- September 1, 1995 --

Signed and Sealed this

Second Day of February, 1999

*Attest:*

*Acting Commissioner of Patents and Trademarks*

*Attesting Officer*